US007849975B2

(12) United States Patent
Ketonen et al.

(10) Patent No.: US 7,849,975 B2
(45) Date of Patent: Dec. 14, 2010

(54) SAFETY ARRANGEMENT OF AN ELEVATOR HAVING SENSORS LIMITING EXTENT OF ELEVATOR TRAVEL

(75) Inventors: Ari Ketonen, Hyvinkää (FI); Ari Kattainen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/487,047

(22) Filed: Jun. 18, 2009

(65) Prior Publication Data

US 2009/0255762 A1 Oct. 15, 2009

Related U.S. Application Data

(63) Continuation of application No. PCT/FI2007/000290, filed on Dec. 13, 2007.

(30) Foreign Application Priority Data

Jan. 3, 2007 (FI) ..... 20070006
Jun. 13, 2007 (FI) ..... 20070469
Jun. 19, 2007 (FI) ..... 20070486

(51) Int. Cl.
*B66B 1/34* (2006.01)

(52) U.S. Cl. ..... 187/394; 187/316

(58) Field of Classification Search ..... 187/300, 187/313, 316, 279, 280, 391–396; 340/545.1, 340/545.3, 545.6, 545.9, 565, 567
See application file for complete search history.

(56) References Cited

U.S. PATENT DOCUMENTS 5,476,157 A * 12/1995 Todaro ..... 187/280
6,032,761 A * 3/2000 Coste et al. ..... 187/294
6,173,814 B1 1/2001 Herkel et al.
6,193,019 B1 * 2/2001 Sirigu et al. ..... 187/391
6,223,861 B1 5/2001 Sansevero
6,550,585 B2 * 4/2003 Schoppa et al. ..... 187/391
6,603,398 B2 * 8/2003 Tinone et al. ..... 340/541
7,201,256 B2 * 4/2007 Deplazes et al. ..... 187/300
7,278,517 B2 * 10/2007 Gut ..... 187/300
7,350,625 B2 * 4/2008 Deplazes et al. ..... 187/393
7,533,763 B2 * 5/2009 Kattainen et al. ..... 187/394
2009/0288920 A1 * 11/2009 Kattainen et al. ..... 187/287

FOREIGN PATENT DOCUMENTS

JP 2006-199404 A 8/2006
WO WO-2006/108433 A1 10/2006

* cited by examiner

*Primary Examiner*—Jonathan Salata
(74) *Attorney, Agent, or Firm*—Birch, Stewart, Kolasch & Kolasch, LLP

(57) ABSTRACT

The invention relates to a safety arrangement of an elevator and a method for implementing safety spaces in an elevator shaft. The elevator has an elevator control system, an elevator motor, a power supply circuit of the elevator motor, and at least one mechanical stopping appliance for preventing movement of the elevator car in the elevator shaft. In the method according to the invention information is read with the control unit from the sensors that measure the position of the landing door of the elevator and possibly information is read from the sensors that measure the position of the door of the elevator car. If it is detected that more landing doors than the door of the elevator car are open, the control unit is switched to the person in the elevator shaft mode and information about the person in the elevator shaft mode is sent with the control unit to the elevator control system.

30 Claims, 3 Drawing Sheets

Figure 1:
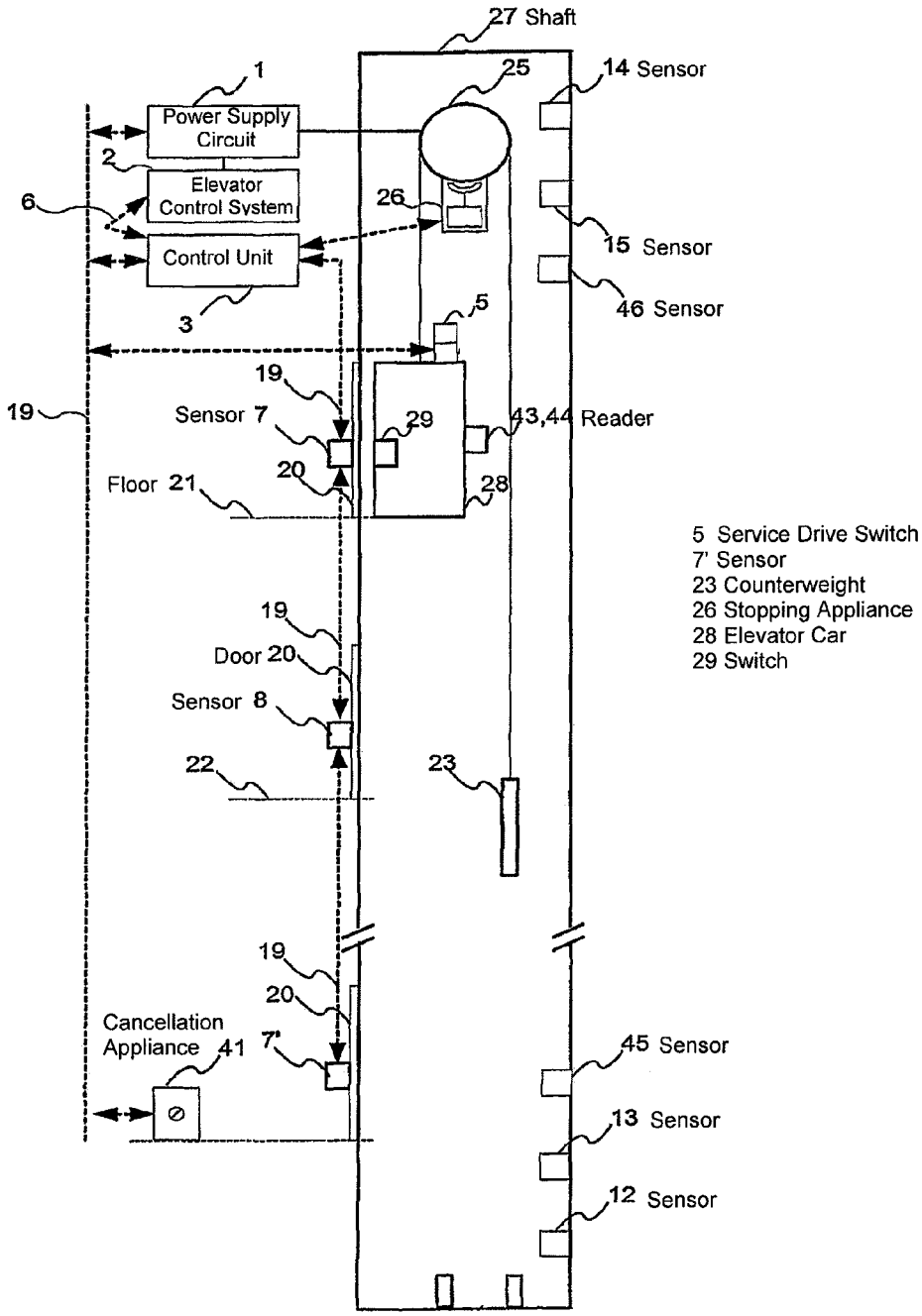

SAFETY ARRANGEMENT OF AN ELEVATOR HAVING SENSORS LIMITING EXTENT OF ELEVATOR TRAVEL

This application is a Continuation of copending PCT International Application No. PCT/FI2007/000290 filed on Dec. 13, 2007, which designated the United States, and on which priority is claimed under 35 U.S.C. §120. This application also claims priority under 35U.S.C. §119(a) on Patent Application Nos. 20070006, 20070469 and 20070486 filed in Finland on Jan. 3, 2007, Jun. 13, 2007 and Jun. 19, 2007. The entire contents of each of the above documents is hereby incorporated by reference.

FIELD OF THE INVENTION

The present invention relates to a safety arrangement of an elevator.

PRIOR ART

When modernizing the elevators of old buildings problems are often encountered because the safety regulations have changed over the years and the headrooms and bottom clearances in the elevator shaft above and below the car in the elevator shaft are not large enough to meet the requirements of modern safety regulations. Extending the shaft upwards or downwards is in most cases impossible in terms of construction engineering or at least so expensive and difficult that it is not viable.

One goal in new buildings is to save space in the elevator shaft. This is done by dimensioning the headrooms and bottom clearances in the elevator shaft to be as small as possible. In this case there is no longer adequate safety space for personnel protection above and below the elevator car for a serviceman working in the elevator shaft or on the roof of the elevator car.

The performance of servicing work in the elevator shaft has become more general owing in particular to so-called elevators without machine room, because in these elevators the hoisting machine and often also the control of the hoisting machine is disposed in the elevator shaft and not in the machine room as is conventional.

Often a turnable buffer situated on the bottom of the shaft is used as a safety device in the service spaces of an elevator shaft, which the serviceman turns to the operating position before working in the elevator shaft. The turnable buffer can be situated below the elevator car on the bottom of the elevator shaft, in which case it limits the movement of the elevator car in the bottom space of the shaft, or it can be situated under the counterweight, in which case it limits the movement of the counterweight in the bottom space of the shaft and simultaneously it limits the movement of the elevator car in the top space of the shaft. When dimensioning the necessary safety clearance of the top space of the elevator shaft, it must be taken into account that in this case when the counterweight collides with the buffer in the bottom end of the shaft the elevator car still continues to move upwards in the top end of the shaft due to its kinetic energy. The length of the movement depends on the maximum possible speed that the elevator car can have in the collision with the counterweight. The safety clearance must therefore be dimensioned to correspond with the maximum possible speed at the time of a collision. In addition, when determining the safety clearance in both the top space and the bottom space of the elevator shaft, the volumetric compression of the buffer caused by the collision must be taken into account.

The level of earlier prior art is presented in the publication WO 97/23399. This publication discloses an appliance to be arranged for the bottom safety space of an elevator, in which a support column is arranged on the path of travel of the car sling, which is turned into the operating state with an actuating element, which is supported on the floor of the shaft and on the support column. The necessary switches, which indicate the position of the support column, are arranged in connection with the support column.

Publication JP03018575 presents a switch installed in connection with a mechanical safety device, the position of which switch changes at the same time as the mechanical safety device is turned into the operating state. Driving with the elevator motor is only permitted when the switching of the mechanical safety device to the operating state can be read from the change of state of the switch.

Publication EP1159218B presents a safety device of an elevator, in which an electrical safety device (a safety controller) reads information from the sensors connected to the elevator system and when detecting that the safety of the elevator system is endangered sends a control signal to the controller of the elevator motor, to the brake of the elevator and also to the control of the elevator system.

Publication EP 1110900 B1 presents a safety arrangement of an elevator, in which safety switches are fitted in connection with the landing doors of the elevator, which switches open when the landing door opens onto the elevator shaft. The arrangement comprises a safety device, which activates automatically when the serviceman opens the door of the elevator shaft for servicing work. The activation occurs such that a safety switch fitted in connection with the lock of the shaft door opens when the serviceman opens the shaft door with a key. The safety arrangement also comprises temporary limit switches during servicing, which the control system of the elevator reads and on the basis of which it monitors the movement of the elevator car in the elevator shaft.

Publication US 2005/0098390 A1 presents a safety arrangement of an elevator, which comprises a certain kind of control unit, sensors that measure the position of the landing doors of the elevator, a sensor that measures the position of the door of the elevator car, end-limit sensors in connection with both ends of the elevator shaft, and also a data transfer channel between the sensors of the doors and the control unit.

Publication US 2006/0157305 A1 presents a safety arrangement of an elevator, which comprises sensors in connection with the landing doors of the elevator for detecting the position of the landing doors, a sensor in connection with the door of the elevator car, end-limit sensors in connection with both ends of the elevator shaft, a sensor in connection with the buffer, a control unit, which reads the information from the sensors, and also a data transfer channel between the sensors and the control unit.

PURPOSE OF THE INVENTION

The purpose of the invention is to present a safety arrangement and a method for setting the safety spaces of an elevator in the elector shaft. One purpose of the invention is to disclose a safety arrangement that is centrally monitored with an electrical control unit, which is simpler than prior art and more diversified in its operating methods than prior art.

CHARACTERISTIC FEATURES OF THE INVENTION

Some inventive embodiments are also-discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

The present invention relates to a safety arrangement of an elevator and to a method according to the safety arrangement.

In one safety arrangement of an elevator according to the invention the elevator comprises an elevator control system, an elevator motor, a power supply circuit of the elevator motor as well as at least one mechanical stopping appliance for preventing movement of the elevator car. The safety arrangement according to the invention further comprises:

- a measuring arrangement for monitoring the safety spaces of the elevator
- a control unit
- a first data transfer channel between the measuring system for monitoring the safety spaces of the elevator and the control unit
- a second data transfer channel between the elevator control system and the control unit One measuring arrangement for monitoring the safety spaces of the elevator according to the invention comprises normal drive limit switches in the upper part and the lower part of the elevator shaft for setting the end limits of movement of the elevator car in normal drive.

One measuring arrangement for monitoring the safety spaces of the elevator according to the invention comprises service space limit switches in the upper part and the lower part of the elevator shaft for setting service spaces in the elevator shaft, which service space limit switches are situated farther from the ends of the elevator shaft than the normal drive limit switches.

An elevator control system generally refers to a control arrangement that is needed to conduct the elevator from floor to floor according to the elevator calls. Thus this elevator control system comprises at least regulation of the processing of car calls, of the processing of elevator traffic and of the movement of the elevator car. The power supply circuit of the elevator motor refers to a circuit with which the power needed to move the car is supplied to the motor of the elevator car. This kind of circuit can be, for instance, the main current circuit of a frequency converter.

The elevator motor can be a rotating motor or a linear motor. The motor can be disposed in the elevator shaft or in a machine room. The mechanical stopping appliance can be a device that can be connected in a braking manner to a moving part of the elevator machine or, for instance, a device that can be connected to the guide rail of the elevator car in a way that brakes the elevator car.

The measuring arrangement for monitoring the safety spaces of the elevator refers to measurements situated in different points that are from the safety standpoint important to the elevator system, by means of which the state of the safety spaces of the elevator, such as the safety spaces of the elevator shaft, are monitored and defined. For example the position of the landing doors of the elevator shaft can be measured with the safety switches of the landing doors and with the reading electronics of the switches.

The control unit reads information from the measuring arrangement for monitoring the safety spaces of the elevator and on the basis of the measurements makes inferences about the safety spaces. The control unit can e.g. read the position information of the doors of the elevator shaft and, if any, of the elevator car and infer on the basis of the position information whether an elevator fitter has moved into the elevator shaft. In this case the control unit can switch to the person in the elevator shaft mode and limit adequate safety spaces in the elevator shaft for the working of the elevator fitter. When it detects that safety is endangered the control unit can control one or more mechanical stopping appliances.

The control unit can be implemented e.g. with a microcontroller, with a programmable logic circuit, with programmable logic or with relays. The control unit can also comprise at least two microcontrollers, or some other independently operating logic control, which operate independently irrespective of each other and additionally communicate with each other via a separate communication channel and thus monitor each other's operation in order to improve the safety of the control unit.

A first data transfer channel refers to a channel between the control unit and the measuring arrangement for monitoring the safety spaces of the elevator. The measuring arrangement for monitoring the safety spaces of the elevator can comprise sensors, and electronics for reading the measuring signals of the sensors can be fitted in connection with the sensors. A transmitter and/or a receiver, which is connected to the first data transfer channel for sending sensor information to the control unit, can further be fitted in connection with the sensors. A transmitter and/or a receiver can also be fitted in connection with the control unit, via which a read request is sent to the measuring arrangement for reading the sensor information and via which the sensor information coming from the measuring arrangement is read.

A second data transfer channel is fitted between the elevator control system and the control unit. The control unit is fitted to send at least information about its operating mode to the elevator control system via the second data transfer channel. If, for example, the control unit has switched to service drive mode, it can send information about this to the elevator control system, in which case the elevator control system limits movement to a permitted area in the elevator shaft, and does not try to drive the elevator car into the area reserved as the safety space of the serviceman. In order to limit the movement of the elevator car in the elevator shaft, the elevator control system needs some kind of information about the position of the elevator car in the elevator shaft. This information can come e.g. from an encoder fitted in connection with the hoisting machine or with the elevator car or from the position sensors of the elevator car, such as from limit switches from the elevator shaft. If, on the other hand, the control unit has switched to the drive prevented mode it can, in addition to preventing movement of the elevator car by controlling a mechanical stopping appliance, also send information about the drive prevented mode to the elevator control system via the second data transfer channel. The elevator control system does not in this case attempt in vain to start the elevator.

In one safety arrangement of an elevator according to the invention the control unit comprises:

- a control of the mechanical stopping appliance, and
- means for disconnecting the power supply circuit of the elevator motor and one measuring arrangement for monitoring the safety spaces of the elevator according to the invention comprises:

- sensors that measure the position of the landing door of the elevator

The control of the mechanical stopping appliance can comprise, for instance, a controllable switch in the power supply circuit of the machinery brake, and the control unit can contain an output for the control signal of the controllable switch. The control unit can, by controlling the switch, open the power supply circuit of the machinery brake and thus prevent opening of the machinery brake. The mechanical stopping appliance can also be, for instance, a guide rail brake that brakes the elevator car to the guide rail. The control of the mechanical stopping appliance can in this case comprise the power supply of the control of the guide rail brake. The control unit can also be fitted to prevent power supply to the control of the guide rail brake, in which case the car brake does not open and the elevator car is not able to move.

The mechanical stopping appliance can also be e.g. a wedge brake connected to the guide rails of the elevator car. The control of the wedge brake can occur according to prior art via the rope of the mechanical overspeed governor. A solenoid can also be in connection with the rope pulley of the mechanical overspeed governor, which can be controlled closed against the rope pulley in order to lock it. The control unit can in this case comprise the control of the solenoid. The control unit can trigger the operation of the wedge brake, i.e. guide rail gripping, by stopping the rope pulley of the overspeed governor with the control of the solenoid in the middle of an elevator run, in which case gripping of the guide rail starts.

One measuring arrangement for monitoring the safety spaces of the elevator according to the invention comprises a sensor that measures the position of the door of the elevator car in connection with the door operator of the elevator car.

One measuring arrangement for monitoring the safety spaces of the elevator according to the invention comprises service drive sensors in the upper part and the lower part of the elevator shaft for setting the end limits of movement of the elevator car in service drive, which service drive sensors are situated farther from the ends of the elevator shaft than the service space limit switches.

In one safety arrangement according to the invention the control unit comprises operating modes, at least a normal drive mode, a person in the elevator shaft mode, a service drive permitted mode, and a drive prevented mode. The control unit is fitted to recover from other operating modes back to normal drive mode under the control of a manually-operated return appliance.

In one safety arrangement elevator according to the invention the control unit is fitted to monitor the state of motion of the elevator car. After the elevator car has reached the service space limit switch of the lower part of the elevator shaft from above, the control unit is fitted to permit movement of the elevator car only upwards. After the elevator car has reached the service space limit switch of the upper part of the elevator shaft from below, the control unit is fitted to permit movement of the elevator car only downwards. After the elevator car has reached the service space limit switch the control unit stops the elevator car by controlling e.g. the guide rail brake. After this the control unit can send information about this to the elevator control system. The elevator control system can send the kind of drive request to the control unit from which the drive direction is evident, and if this corresponds to the permitted drive direction of the service space limit switch, the control unit permits the run and opens the guide rail brake. On the other hand, the control unit can also measure the direction of movement of the elevator car, and after the opening of the brake the control unit can on the basis of the measurement infer whether the elevator car is leaving from the service space limit switch in the permitted drive direction. If the direction of movement of the elevator car differs from that permitted, the control unit immediately stops the elevator car by controlling the brake.

The aforementioned switches in the measuring arrangement for monitoring the safety spaces of an elevator can be e.g. special safety switches or normal safety switches, the contacts of which are duplicated to increase safety. For example, the sensors that measure the position of the landing door of the elevator can be safety switches, the contacts of which open under forced control when the landing door opens.

In one safety arrangement according to the invention the sensors fitted in connection with the landing doors of the elevator are bi-stable switches that open and remain open when the landing doors open. Means can further be arranged in connection with the switches for closing the switches afterwards.

The service drive sensors can be e.g. limit switches situated at the service drive limit in the elevator shaft, or for instance magnetic switches. A magnet can in this case be disposed at the service drive limit in the elevator shaft, and on the elevator car can be a magnetic switch, which reacts to the magnetic field of the magnet disposed at the service drive limit and by means of which it is thus possible to detect the arrival of the elevator car at the service drive limit. The service drive limit refers to the first limit point, which is located farther from the end of the elevator shaft than the service space limit switch and by means of which it is detected that the elevator car is approaching the service space limit switch. The control of the stopping appliance of the elevator car can be arranged such that when the elevator car arrives at the service drive sensor the machinery brake is controlled for stopping the elevator car. If however the elevator car continues its journey to the service space limit switch, the stopping appliance that grips the guide rail of the elevator car is also controlled, and thus it is endeavored to ensure stopping of the elevator car.

In one safety arrangement according to the invention after the elevator car has reached the service drive sensor the control unit stops the elevator car by controlling the machinery brake. After this the control unit permits the elevator control system to start another new run. If during the new run the elevator car continues its journey towards the end of the elevator shaft arriving at the service space limit switch, the control unit controls the stopping appliance that grips the guide rail of the elevator car and switches to the drive prevented mode, in which case a new run with the elevator is no longer permitted before the drive prevented mode is cancelled by using the manually-operated return appliance.

One safety arrangement according to the invention comprises both a machine brake and a car brake for preventing movement of the elevator car in the elevator shaft. One control unit according to the invention comprises a control of both the machine brake and the car brake.

One measuring arrangement for monitoring the safety spaces of the elevator according to the invention comprises at least one sensor that measures the state of the service drive switch in connection with the service drive unit of the elevator. The service drive switch can be a manually-operated switch, which is situated in the elevator shaft, e.g. on the roof of the elevator car. When a serviceman in this case moves onto the roof of the elevator car, s/he turns the service drive switch into the position that permits service drive. The control unit reads the state of the service drive switch and permits service drive within a restricted area in the elevator shaft.

In one safety arrangement according to the invention the sensors that measure the position of the landing door of the elevator are switches that are connected in series with each other, the contact of which opens when the landing door opens.

In one safety arrangement according to the invention the data transfer channel between the control unit and the series circuit of the switches comprises a resistance fitted in the series circuit in parallel with each aforementioned switch.

In one safety arrangement according to the invention the resistance fitted in parallel with the switch of the landing door of the bottommost floor differs in its resistance value from the resistances fitted in parallel with all the other switches in order to identify the position of the landing door of the bottommost floor. In this case a limit value can be set for the current, on the basis of which it is possible to detect the opening of the switch of the bottommost floor. It is possible to infer on this basis that the serviceman has moved to the bottom of the elevator shaft, in which case the safety spaces can be set in the bottom end of the elevator shaft. Likewise, when the opening of a switch of a landing door of a floor other than the bottommost floor is detected, it can be inferred that the serviceman has moved onto the roof of the elevator car and in this case the safety spaces can be set in the top end of the elevator shaft.

In one safety arrangement according to the invention the aforementioned resistance is preferably an encapsulated film resistance. The structure of the film resistance is such that the resistor element is well protected e.g. against becoming dirty. In this case malfunctioning of the resistance such that the resistor element short circuits is very unlikely.

One control unit according to the invention comprises means for measuring the total resistance of the series circuit.

One measuring arrangement for monitoring the safety spaces of the elevator according to the invention comprises a position sensor that measures the position of the elevator car in the elevator shaft. The position sensor can be e.g. a pulse encoder fitted in connection with the hoisting machine or with the elevator car, from where the position is determined by integrating the pulses. The position information can be read in another way also, e.g. by means of transmitter-receiver pairs that process an acoustic or electromagnetic signal fitted on the elevator car and at the ends of the elevator shaft. An acceleration sensor can further be disposed on the elevator car, and the position information can be determined by integrating first the speed and then the position information from the acceleration signal. The control unit can read the measured position information and if necessary compare it to some other position information measurement. By comparing the measurements the control unit can further ensure the correctness of the measurements.

One measuring arrangement for monitoring the safety spaces of the elevator according to the invention comprises means fitted onto the elevator car for measuring a change of speed of the elevator car. In one embodiment of the invention the movement of the serviceman onto the roof of the elevator car is assessed based on the acceleration data of the elevator car. In other words, in this case the premise is that the movement of the serviceman on the roof of the elevator car causes vibration, which can be measured.

In one safety arrangement according to the invention the first data transfer channel comprises a first and a second data channel, and both the control unit and the measuring arrangement for monitoring the safety spaces of the elevator are fitted to redundantly communicate to the first and second data channel, in which case the same data is sent to both data channels in duplicate and independently of one another.

In one method according to the invention for setting the safety spaces of an elevator:

information is read with the control unit from the sensors that measure the position of the landing door of the elevator information is possibly read from the sensors that measure the position of the door of the elevator car if on the basis of the measurements a landing door is detected opening onto the elevator shaft, the control unit is switched to the person in the elevator shaft mode and driving with the elevator is prevented by controlling at least one mechanical stopping appliance information about the person in the elevator shaft mode is sent with the control unit to the elevator control system In one method according to the invention after the control unit has switched to the person in the elevator shaft mode:

the sensor of the service drive switch is read with the control unit and if it is detected that the service drive switch has switched to service drive mode the control unit is switched to the service drive permitted mode and The state of the service drive limit switches is read with the control unit if a service space limit switch is detected as being open, the control unit switches to the drive prevented mode When the landing door opens onto the elevator shaft, the elevator car is not situated at the location of the landing door, in which case the movement of a person into the shaft is possible. In the method according to the invention it is possible to read information at least about how many landing doors or car doors are open from the sensors that measure the position of the landing door of the elevator as well as from the sensors that measure the position of the door of the elevator car. If more open landing doors are detected than open doors of the elevator car, it can in this case be inferred that the serviceman has moved into the shaft and in this case the control unit can be switched to the so-called person in the elevator shaft mode. The serviceman can move into the elevator shaft e.g. by opening the lock of the landing door with a key equipped for the purpose.

In the person in the elevator shaft mode, driving with the elevator is prevented. The control unit ultimately handles this by controlling the mechanical stopping appliance that prevents movement of the elevator car. When the serviceman turns the service drive switch situated in the elevator shaft, e.g. on the roof of the elevator car, to the service drive position, the control unit reads the change of state of the switch and permits service drive. In this case the control unit also limits the movement of the elevator car on service drive to the permitted area defined with the service space switches. In practice this occurs such that when the elevator car arrives at the service space limit switch the switch opens, the control unit reads the opening of the switch and prevents movement of the elevator car by controlling at least one mechanical stopping appliance.

The control unit can also monitor the movement of the elevator car on service drive dependently of the direction, such that when the elevator car arrives at the service space limit switch situated in the bottom end of the elevator shaft from above, the control unit prevents movement of the elevator car downwards, but permits movement upwards. Likewise when the elevator car arrives at the service space limit switch situated in the top end of the elevator shaft in the direction from below, the control unit prevents movement of the elevator car upwards, but permits movement downwards. It is further possible that only the service space limit switch situated in the top end or in the bottom end of the shaft is activated depending on whether the serviceman has moved to the bottom of the elevator shaft or onto the roof of the elevator car.

A manually-operated switch for canceling the person in the elevator shaft mode can also be in connection with the control unit.

The control unit can also be fitted to switch to the person in the elevator shaft mode always afterwards in conjunction with an electrical power cut if also the backup drive, such as an accumulator, has ceased to supply operating electricity to the safety arrangement. In this case driving with the elevator is not possible before the serviceman visits the site to cancel the person in the elevator shaft mode. This prevents a hazardous situation, which could arise when a person moves into the elevator shaft after loss of electricity from the safety arrangement.

In one method according to the invention, after the control unit has switched to the drive prevented mode:

- movement of the elevator car in the elevator shaft is prevented by controlling the car brake with the control unit and
- driving with the elevator is prevented by controlling the power supply circuit of the elevator motor open with the control unit The car brake in this context refers to any braking appliance whatsoever that can be connected mechanically to the guide rail of the elevator car, such as a guide rail brake or a wedge brake.

In one method according to the invention the switches that determine the position of the landing door are arranged in series into a series circuit and resistances that are just as great are fitted in parallel with the switches. In the aforementioned method according to the invention:

- Voltage is supplied with the control unit to the series circuit through the series resistance connected to the voltage output of the control unit
- The current flowing in the series circuit is measured
- The measured current is compared to at least the predefined limit values of current R1, R2, . . . , Rn, which limit values are selected on the basis of the number of switches that are open
- If the measured current is greater than the predefined limit value R1, it is inferred that all the switches of landing doors fitted to the series circuit are closed
- If the measured current is within the range R2, . . . , Rn of the predefined limit value of the current, the number of the switches that are open is inferred such that the smallest limit value Rn corresponds to the largest amount of switches that are open and as the value of the current grows the number of switches that are open decreases When all the switches of the series circuit are closed, only the series resistance connected to the voltage output of the control unit limits the current flowing in the circuit. If one of the switches opens, the current starts to travel via the resistance fitted in parallel with the switch, in which case the resistance also starts to limit the current. The current decreases as the number of open switches increases, in which case by means of a measurement of the current of the series circuit the number of switches that are open can be detected.

In the embodiment of the invention a separate series resistance is not necessarily needed in the voltage output of the electrical safety device. In this case the current of the voltage output is limited with some other method, e.g. by means an active current limiting circuit formed by means of transistors.

In one method according to the invention the resistance fitted in parallel with the switch of the landing door of the bottommost floor differs in its resistance value from the resistances fitted in parallel with all the other switches in order to identify the position of the landing door of the bottommost floor. In the aforementioned method according to the invention:

- Voltage is supplied with the control unit to the series circuit through the series resistance connected to the voltage output of the control unit.
- The current flowing in the series circuit is measured
- The measured current is compared to at least the following pre-defined limit values of current:
  - a. to the limit value R1, which corresponds to the value of the current when all the switches are closed
  - b. to the limit value R2, which corresponds to the value of the current when the switch of the landing door of only the bottommost floor is open
  - c. to the limit value R3, which corresponds to the value of the current when the switch of a landing door of a floor differing from the bottommost floor is open
- if the measured current in the person in the elevator shaft mode corresponds within the framework of a predefined tolerance to some limit value specified in at least points a, b or c, the positions of the switches of the landing door are inferred as follows:
  - if the measured current corresponds to the limit value of point b, it is inferred that the serviceman has moved to the bottom of the shaft and the movement of the elevator car downwards is limited to end at the service space limit switch of the lower part of the elevator shaft
  - if the measured current corresponds to the limit value of point c, it is inferred that the serviceman has moved to the roof of the elevator car and the movement of the elevator car upwards is limited to end at the service space limit switch of the upper part of the elevator shaft In one method according to the invention:

- The current going into the series circuit is measured
- The current returning from the series circuit is measured
- The current going into the series circuit and returning from the series circuit are compared with each other
- If the values of the incoming and the returning current differ from each other by more than a pre-defined limit value, an inference is made about malfunctioning of the series circuit, driving with the elevator is prevented by controlling at least one mechanical stopping appliance (26) with the control unit (3) and
- a fault notification containing a prevent drive command is sent with the control unit (3) to the elevator control system By measuring the current going into the series circuit and returning from the series circuit it is possible to infer malfunctioning of the series circuit, e.g. a shortage to ground.

ADVANTAGES OF THE INVENTION

The invention achieves at least one of the following advantages:

With the arrangement according to the invention the person in the elevator shaft mode can be identified more simply than prior art by adding only one resistance in parallel with each landing door contact.

Since in the safety arrangement according to the invention the safety spaces of the elevator are monitored with a separate control unit, the signals to be monitored can be filtered using a software program in the control unit according to need. In this case the system is immune to short-term breaks in the contacts of the switches. When the operational disturbances of the elevator system caused by these short-term breaks decrease, the reliability and utilization rate of the elevator system improve.

The safety arrangement according to the invention requires very complex operating logic so that it is possible to ensure that the system detects all possible fault situations. The logic used must exclude all operating modes in which service drive is prohibited and permit those operating modes in which service drive is permitted. Furthermore the system must be able to infer malfunctioning of the sensors. In the safety arrangement according to the invention the monitoring of operation is performed centrally in an electrical safety device, which simplifies the implementation compared to a solution implemented with different components. At the same time the total amount of components in the system decreases and the reliability of the system improves.

The electrical safety system according to the invention contains separate normal drive limit switches as well as service space limit switches. Since in the safety arrangement according to the invention both the choice about which end-limit switches are used when and an inference about the operating mode of the safety arrangement are made centrally with an electrical safety device, it is possible to ensure that the operating mode of the safety arrangement set by the control unit by means of measurements of the safety spaces corresponds to the end-limit sensors used. When reading the end-limit sensors with the control unit it is possible to ensure that the service space limit switches are in use in a situation in which the serviceman is in the elevator shaft.

By means of the electrical safety device it is also possible to allow the reading logic of the service space limit switches to be dependent on the direction, in which case movement of the elevator car away from the service space limit switch is prohibited in only one direction and moving away from the service space limit switch is possible for recovering from the fault situation. Further, it is possible that the control unit takes into use only the service space limit switch of the upper part or of the lower part of the elevator shaft, and the normal drive limit switch located closer to the end of the elevator shaft can be used as a second limit switch. In this case service drive is possible in a larger area of the elevator shaft.

When the switches incorporated in the safety arrangement are read in the manner presented in the invention by measuring the current traveling through the resistances fitted in connection with the switches, the state of the switches connected in series can be determined with the control unit by means of only one current measurement. This simplifies the interface between the control unit and the readable switches. When using encapsulated film resistances in parallel with the switches, the malfunctioning of a resistance due to short-circuiting is very improbable. Since the failure of a resistance by breaking is always detectable with the control unit, it is possible by means of the resistances to measure also the safety circuits, such as the series circuit of the switches of a landing door. Resistors are also inexpensive as components to use in measurements. If different sized resistances in terms of their magnitude are fitted in parallel with the switches of the landing door of the bottommost floor than those in parallel with the switches of the landing doors of the other floors, there is a possibility to detect the opening of the landing door of in particular the bottommost floor with current measurement. In this case it can be inferred whether the elevator fitter has moved to the bottom of the shaft or onto the roof of the elevator car.

In the safety arrangement according to the invention it is possible to read the sensors centrally. A serial bus can be arranged between them or they can be connected in series. In this case the amount of cabling is reduced.

In the safety arrangement according to the invention it is also possible to monitor the functioning of the different sensors with the control unit, and any malfunctioning can be detected. Further, it is possible to distinguish a fault situation of an individual sensor and it is possible to send information about this directly to the service center, in which case diagnostics of the system improves.

When the amount of separate components, such as relays, in the safety arrangement decreases, the characteristic problems of these components that are caused by wear and limit the lifetime also decrease.

PRESENTATION OF DRAWINGS

Figure 2:
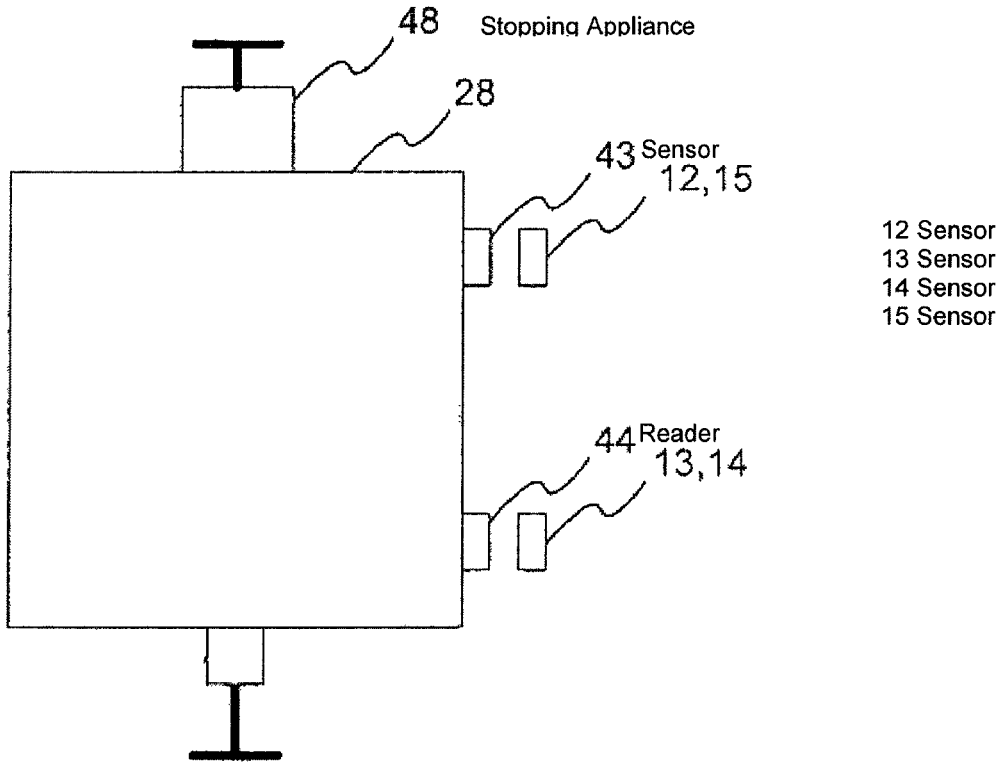

In the following, the invention will be described in more detail with reference to the attached drawings, wherein FIG. 1 presents one safety arrangement according to the invention FIG. 2 presents a top view of an elevator car 28 according to FIG. 1

Figure 3:
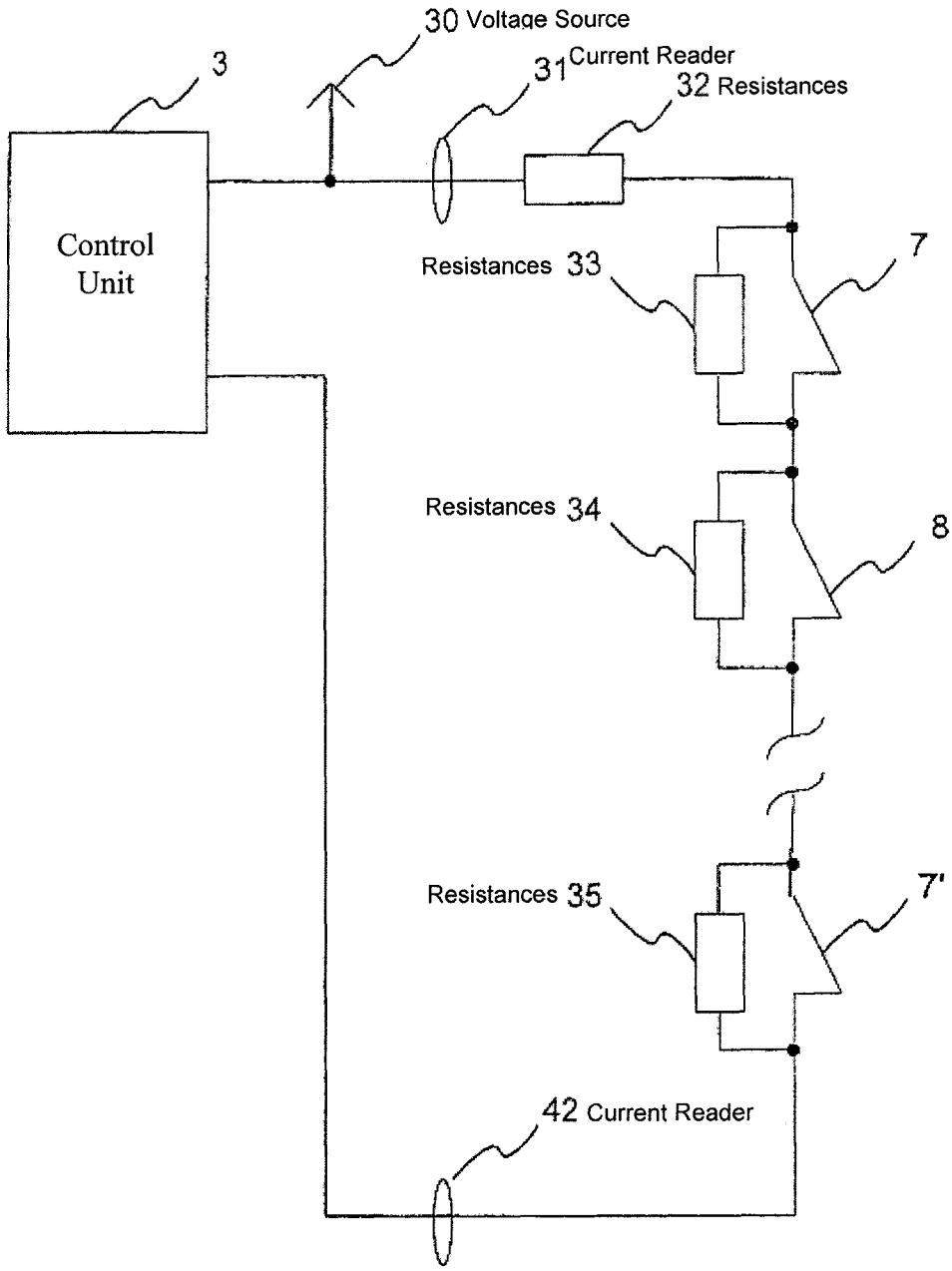

FIG. 3 presents a measuring arrangement for monitoring the safety spaces of the elevator

EMBODIMENTS

FIG. 1 presents one elevator, in which the safety arrangement according to the invention is applied. The elevator car 28 is fitted to move in the elevator shaft 27 from floor to floor 21, 22. This elevator system according to this invention also contains a counterweight 23, but the elevator system according to the invention can also be one without counterweight. The elevator motor 25 is situated in the elevator shaft, but it can also be situated in a machine room.

In one embodiment of the invention the end limits of movement of the elevator car in the elevator shaft are set by the end-limit sensors 12, 13, 14, 15, 45, 46. During normal drive the elevator car travels between the end limits defined by the end-limit switches 12, 14. After the serviceman has moved into the elevator shaft the control unit 3 switches at first into the person in the elevator shaft mode. In this case the control unit prevents driving with the elevator by controlling the mechanical stopping appliance 26, 48. The control unit can also read the position of the service drive switch 5 and when it detects that the position of the switch has changed to the service drive mode, the control unit switches to the service drive permitted mode, in which case service drive can be driven with the elevator in the area in the elevator shaft determined by the service space limit switches 13, 15 and possibly also by the service drive sensors 45, 46. If the service drive sensors 45, 46 have been fitted in the elevator shaft, service drive is permitted only in the area between the service drive sensors. When the elevator car arrives e.g. at the service drive sensor 45 of the lower part of the elevator shaft, the control unit 3 reads the state of the service drive sensor and controls the machinery brake to stop the elevator car. If the elevator car however continues its travel onwards to the service space limit switch 13, the control unit controls the guide rail brake 48 of the elevator car to stop the elevator car and in this case the control unit also switches to the drive prevented mode. After the control unit has switched to the drive prevented mode drive is prevented until the prevention mode is cancelled by means of the manually-operated cancellation appliance 41. The cancellation appliance is connected to the first data transfer channel 19, and the control unit reads the state of the cancellation appliance via the first data transfer channel. If there are no service drive sensors 45, 46 in the elevator shaft, it is possible to drive a service run with the elevator in the area between the service space limit switches 13, 15. In this case when the elevator car arrives at the service space limit switch the control unit controls the guide rail brake 48.

The control unit 3 reads the switches 7, 7', 8 that measure the position of the landing door as well as the switch 29 that measures the position of the door of the elevator car via the first data transfer channel 19 and infers on the basis of the position of these to switch the safety arrangement to the person in the elevator shaft mode. In this case both the normal drive and the service drive of the elevator is prevented. The control unit 3 also reads the manually-operated switch, i.e. the service drive switch 45, that expresses the state of the service drive unit of the elevator through the first data transfer channel 19. When the serviceman turns the switch to the service drive position, the switch opens. After the service drive switch 5 has switched to service drive mode the control unit 3 permits service drive.

In this embodiment of the invention the control unit also reads the normal drive limit switches 12, 14, the service space limit switches 13, 15, and the service drive sensors 45, 46 via the first data transfer channel 19.

FIG. 2 also presents a second embodiment of the invention, in which readers 43, 44 of the end-limit sensors are disposed in connection with the elevator car. In this embodiment of the invention ramps are used as the end-limit sensors and switches, which can be brought into contact with the ramps, are used as the readers of the end-limit sensor.

In this embodiment the elevator shaft contains two different end-limit sensors for setting the end limits of movement of the elevator. With normal drive it is possible to drive closer to the end according to the ramps 12, 14. In service mode the end limits of movement are limited with the ramps 13, 15. The control unit 3 reads the position of the elevator car in the elevator shaft with the switches 43, 44 and stops the elevator when it drives past the ramp by controlling the guide rail brake 48. The switch opens when it makes contact with the ramp. In this embodiment of the invention the switches are fitted to be interleaved with the ramps such that the switch 43 reads the ramps 12 and 15 and the switch 44 reads the ramps 13 and 14. This is done by disposing the ramps 12 and 15 in the elevator shaft such that they are in the path of movement of the switch 43, and the sensors 13 and 14 such that they are in the path of movement of the switch 44, as the elevator car moves in the elevator shaft.

The control unit 3 prevents both service drive and normal drive when it detects that both switches 43 and 44 are open. If only switch 43 is open, service drive upwards is prevented. If, on the other hand, only switch 44 is open, service drive downwards is prevented.

The control unit 3 makes an inference about the operating mode of the safety arrangement of the elevator. When it detects an operational deviation on the basis of information it reads from the sensors, it controls the machine brake 26 and/or the guide rail brake 48. In addition it sends a drive prevented command to the elevator control system 2 via the second data transfer channel 6.

When the control unit detects the person in the shaft mode, it records information about this in the non-volatile memory of the safety device. After this the control unit can return to a mode that permits normal drive only by means of the manually-operated return appliance 41. In the safety arrangement according to FIG. 1 the manually-operated return appliance is disposed on the bottommost floor of the elevator shaft and the control unit reads the state of the return appliance through the first data transfer channel 19. The manually-operated return appliance 41 can also be disposed directly in connection with the control unit 3 and the control unit 3 can read the state of the return appliance 42 via its own separate connection channel.

FIG. 3 presents one appliance according to the invention, with which the operating mode of the switches 7, 7', 8 of the safety arrangement can be read. These switches are connected into a series circuit and the resistances 33, 34, 35 are fitted in parallel with them. The series circuit is connected to the control unit 3. With the control unit a voltage 30 is supplied to the series circuit via the series resistance 32. In addition the appliance comprises means 31, 42 for measuring the current traveling in the series circuit.

With the control unit 3 a known voltage 30 is supplied to the series circuit through the series resistance 32. When the switches 7, 7', 8 are closed, the current traveling in the series circuit is limited only by the resistance 32. In this case the current can be measured with the measuring devices 31, 42 and correspondingly the state of the series circuit can be read. When one of the switches opens, the path of the current through the switch is disconnected and the current starts to travel through the resistance fitted in parallel with the switch. For example, when the switch 7 opens, the current starts to travel through the resistance 33. Simultaneously the current traveling in the series circuit decreases because the series connection of the resistances 32 and 33 restricts the passage of the current. If in addition the switch 8 opens, the current decreases still further because the series connection of the resistances 32, 33 and 34 restricts its passage. When measuring the current traveling in the series circuit with the measuring devices 31, 42, it is possible to detect a change in the current and simultaneously a change in the state of the switches of the series circuit corresponding to the current change.

When resistances of the same size in terms of their resistance values are in parallel with all the switches 7, 7', 8, the opening of one or more switches can be detected by means of current measuring. The more switches that are open, the smaller is the current traveling in the series circuit. In this case, however, it is not possible to identify which specific switch is open. On the other hand, if a resistance that differs from the others in its resistance value is selected as the resistance 35 connected in parallel with the switch 7' of the bottommost floor, the state of the switch 7' of the bottommost floor can be detected. In this case when selecting the resistances the combinations of the different resistances must also be taken into account such that the value of the resistance of the bottommost floor always differs in combinations of a series circuit of two or more different resistances so that detection of the state of the switch 7' of the bottommost floor is possible.

With the appliance according to FIG. 3 it is possible to also detect malfunctioning of the series circuit, e.g. a shortage to ground. In this case the current coming into the series circuit from the control unit 3 is measured with the measuring device 31 and the current returning to the control unit 3 from the series circuit is measured with the measuring device 42. In the case of a shortage to earth some of the current supplied to the series circuit passes from the series circuit into other structures at the point of the short-circuit and only a part returns back to the control unit 3 along the series circuit. The returning current is measured with the measuring device 42, and by comparing the current leaving the series circuit and the current returning to the series circuit a fault situation can be detected.

The invention is further described by the aid of a few examples of its embodiment. It is obvious to the person skilled in the art that the invention is not limited to the embodiments described above, but that many other applications are possible within the scope of the inventive concept defined by the claims presented below.

The invention claimed is:

1. A safety arrangement of an elevator, which elevator comprising an elevator control system, an elevator motor, a power supply circuit of the elevator motor as well as at least one mechanical stopping appliance for preventing movement of the elevator car, the safety arrangement comprising:

a measuring arrangement for monitoring the safety spaces of the elevator;

a control unit;

a first data transfer channel between the said measuring arrangement and the control unit;

a second data transfer channel between the elevator control system and the control unit;

wherein the measuring arrangement for monitoring the safety spaces of the elevator comprises:

normal drive limit switches in an upper part and a lower part of an elevator shaft for setting the end limits of movement of the elevator car in normal drive, service space limit switches in the upper part and the lower part of the elevator shaft for setting service spaces in the elevator shaft, which service space limit switches are situated farther from the ends of the elevator shaft than the normal drive limit switches, wherein the measuring arrangement for monitoring the safety spaces of the elevator comprises service drive sensors in the upper part and the lower part of the elevator shaft for setting the end limits of movement of the elevator car in service drive permitted mode, which service drive sensors are situated farther from the ends of the elevator shaft than the service space limit switches, and wherein the control unit stops the elevator car by controlling the mechanical stopping appliance when the elevator car reaches the service drive sensors and then permits the elevator control system to start another run, the control unit switching to a drive prevented mode if the elevator car reaches a service space limit switch, and a manually operated return appliance to cancel the drive prevented mode.

2. The safety arrangement of an elevator according to claim 1, wherein the control unit comprises: a control of the mechanical stopping appliance, and means for disconnecting the power supply circuit of the elevator motor.

3. The safety arrangement according to claim 1, wherein the measuring arrangement for monitoring the safety spaces of the elevator comprises:

sensors that measure the position of the landing door of the elevator.

4. The safety arrangement according to claim 1, wherein the measuring arrangement for monitoring the safety spaces of the elevator comprises a sensor that measures the position of the door of the elevator car in connection with the door operator of the elevator car.

5. The safety arrangement according to claim 1, wherein the control unit comprises operating modes, at least the normal drive mode, a person in the elevator shaft mode, the service drive permitted mode, and the drive prevented mode, and in that the control unit is fitted to recover from other operating modes to normal drive mode with the control of a manually-operated return appliance.

6. The safety arrangement according to claim 1, wherein the control unit is fitted to monitor the state of motion of the elevator car and in that after the elevator car has reached the service space limit switch of the lower part of the elevator shaft from above, the control unit is fitted to permit movement of the elevator car only upwards and in that after the elevator car has reached the service space limit switch of the upper part of the elevator shaft from below, the control unit is fitted to permit movement of the elevator car only downwards.

7. The safety arrangement according to claim 1, wherein the safety arrangement comprises both a machine brake and a car brake for preventing movement of the elevator car in the elevator shaft and in that the control unit comprises a control of both a machine brake and a car brake.

8. The safety arrangement according to claim 1, wherein the measuring arrangement for monitoring the safety spaces of the elevator comprises a sensor that measures the state of at least one service drive switch in connection with the service drive unit of the elevator.

9. The safety arrangement according to claim 3, wherein the sensors that measure the position of the landing door of the elevator are switches that are connected in series with each other, the contact of which opens when the landing door opens.

10. The safety arrangement according to claim 9, wherein the data transfer channel between the control unit and the switches comprises a resistance fitted in the series circuit in parallel with each aforementioned switch.

11. The safety arrangement according to claim 10, wherein the resistance fitted in parallel with the switch of the landing door of the bottommost floor differs in its resistance value from the resistances fitted in parallel with all the other switches in order to identify the position of the landing door of the bottommost floor.

12. The safety arrangement according to claim 10, wherein the aforementioned resistance is preferably an encapsulated film resistance.

13. The safety arrangement according to-claim 9, wherein the control unit comprises means for measuring the total resistance of the series circuit.

14. The safety arrangement according to claim 1, wherein the measuring arrangement for monitoring the safety spaces of the elevator comprises a position sensor that measures the position of the elevator car in the elevator shaft.

15. The safety arrangement according to claim 1, wherein the measuring arrangement for monitoring the safety spaces of the elevator comprises means for measuring a change of speed of the elevator car fitted to the elevator car.

16. A method for setting the safety spaces of an elevator, comprising:

reading information with a control unit from sensors that measure the position of a landing door of the elevator car, information is read from the sensors that measure the position of the landing door of the elevator car and if, on the basis of the measurements the landing door is detected opening onto the elevator shaft, the control unit is switched to a person in the elevator shaft mode; and preventing driving of the elevator car by controlling at least one mechanical stopping appliance;

sending information about the person in the elevator shaft mode to an elevator control system;

wherein, after the control unit has switched to the person in the elevator shaft mode, a service drive switch is read with the control unit and, if it is detected that the service drive switch has switched to service drive mode, the control unit is switched to a service drive permitted mode and states of service space limit switches are read with the control unit and, if a service space limit switch is detected as being open, the control unit switches to a drive prevented mode, monitoring the safety spaces of the elevator with service drive sensors in the upper part and the lower part of the elevator shaft for setting the end limits of movement of the elevator car in service drive, the service drive sensors situated farther from the ends of the elevator shaft than the service space limit switches, stopping the elevator car by controlling the mechanical stopping appliance when the elevator car reaches the service drive sensors and then permitting the elevator control system to start another run;

switching to a drive prevented mode if the elevator car reaches a service space limit switch, and canceling the drive prevented mode with a manually operated return appliance.

17. The method according to claim 16, wherein after the control unit has switched to the drive prevented mode:

movement of the elevator car in the elevator shaft is prevented by controlling the mechanical stopping appliance with the control unit and driving the elevator car is prevented by controlling the power supply circuit of an elevator motor with the control unit.

18. The method according to claim 16, wherein the sensors that measure the position of the landing door are switches arranged in series into a series circuit and equal resistances are arranged in parallel with the switches, wherein voltage is supplied to the series circuit through the series resistance connected to a voltage output of the control unit current flowing in the series circuit is measured the measured current is compared to pre-defined limit values of current R1, R2, . . . , Rn, the limit values selected on the basis of the number of switches that are open;

if the measured current is greater than the predefined limit value R1, it is inferred that all the switches of landing doors fitted to the series circuit are closed;

if the measured current is within the range R2, . . . , Rn of the predefined limit value of the current, the number of the switches that are open is inferred such that the smallest limit value Rn corresponds to the largest amount of switches that are open and, as the value of the current grows, the number of switches that are open decreases.

19. The method according to claim 16, wherein a resistance fitted in parallel with the switch of the landing door of the bottommost floor differs in resistance value from resistances fitted in parallel with all other switches in order to identify the position of the landing door of the bottommost floor and in that in the method: P1 voltage is supplied to the series circuit through the series resistance connected to a voltage output of the control unit;

the current flowing in the series circuit is measured;

the measured current is compared to at least the following pre-defined limit values of current; wherein a. R1 corresponds to the value of the current when all the switches are closed b. R2 corresponds to the value of the current when the switch of the landing door of only the bottommost floor is open c. R3 corresponds to the value of the current when the switch of a landing door of a floor differing from the bottommost floor is open if the measured current in the person in the elevator shaft mode corresponds within the framework of a predefined tolerance to some limit value specified in at least points a, b or c, the positions of the switches of the landing door are inferred as follows:

if the measured current corresponds to the limit value of point b, it is inferred that a serviceman has moved to the bottom of the shaft and movement of the elevator car downwards is limited to end at the service space limit switch of the lower part of the elevator shaft if the measured current corresponds to the limit value of point c, it is inferred that the serviceman has moved to the roof of the elevator car and movement of the elevator car upwards is limited to end at the service space limit switch of the upper part of the elevator shaft.

20. The method according to claim 18, wherein in the method;

current going into the series circuit is measured;

current returning from the series circuit is measured;

the current going into the series circuit and returning from the series circuit are compared with each other;

if the values of the incoming and the returning current differ from each other by more than a pre-defined limit value, an inference is made about malfunctioning of the series circuit, driving with the elevator car is prevented by controlling at least one mechanical stopping appliance with the control unit; and a fault notification containing a prevent drive command is sent with the control unit to the elevator control system.

21. A safety arrangement in an elevator, comprising:

an elevator shaft having a top and a bottom;

a plurality of floors connected to the elevator shaft;

a landing door on each floor;

an elevator car movable within the elevator shaft along a travel path, the elevator car having an elevator door;

a first normal drive limit sensor near the bottom of the elevator shaft and a second normal drive limit sensor near the top of the elevator shaft, the normal drive limit sensors defining the end limits of the travel path of the elevator car when the elevator is in a normal mode;

a first service space limit sensor near the bottom of the elevator shaft and further from the bottom than the first normal drive limit sensor and a second service space limit sensor near the top of the elevator shaft and further from the top than the second normal drive limit switch, the service space limit sensors defining the end limits of the travel path of the elevator car when the elevator is in a service drive mode;

a control unit controlling the movement of the elevator car within the elevator shaft; and a reader on the elevator car for reading the normal drive limit sensors and service space limit sensor.

22. The safety arrangement of claim 21, further comprising:

a service drive switch for switching from the normal mode to the service drive mode.

23. The safety arrangement of claim 21, wherein the service drive switch is on the elevator car.

24. The safety arrangement of claim 21, further comprising sensors for indicating a person has entered the elevator shaft.

25. The safety arrangement of claim 24, wherein the sensors for indicating a person has entered the elevator shaft comprises:

a position sensor on the elevator car; and a circuit, the circuit comprising:

a switch at each landing door, the switch being closed when the landing door is closed and the switch being open when the landing door is open;

a resistor in parallel with each switch;

a voltage source; and a current reader, wherein the wherein the sensors for indicating a person has entered the elevator shaft can determine if a landing door is opened when the elevator car is not at the landing door.

26. A safety arrangement in an elevator, comprising:

an elevator shaft having a top and a bottom;

a plurality of floors connected to the elevator shaft;

a landing door on each floor;

an elevator car movable within the elevator shaft along a travel path, the elevator car having an elevator door;

a first normal drive limit sensor near the bottom of the elevator shaft and a second normal drive limit sensor near the top of the elevator shaft, the normal drive limit sensors defining the end limits of the travel path of the elevator car when the elevator is in a normal mode;

a first service space limit sensor near the bottom of the elevator shaft and further from the bottom than the first normal drive limit sensor and a second service space limit sensor near the top of the elevator shaft and further from the top than the second normal drive limit switch, the service space limit sensors defining the end limits of the travel path of the elevator car when the elevator is in a service drive mode;

a control unit controlling the movement of the elevator car within the elevator;

sensors for indicating a person has entered the elevator shaft, wherein the sensors for indicating a person has entered the elevator shaft comprises:

a position sensor on the elevator car; and a circuit, the circuit comprising:

a switch at each landing door, the switch being closed when the landing door is closed and the switch being open when the landing door is open;

a resistor in parallel with each switch;

a voltage source; and a current reader, wherein the wherein the sensors for indicating a person has entered the elevator shaft can determine if a landing door is opened when the elevator car is not at the landing door, and wherein a bottom-most landing door has a resistor with a value different than any other resistor.

27. The safety arrangement of claim 21, further comprising:

a first person in shaft sensor between the first normal drive limit sensor and the first service space limit sensor; and a second person in shaft sensor between the second normal drive limit sensor and the second service space limit sensor, wherein the person in shaft sensors stop the elevator car if it passes the service space limit sensors in the service drive mode.

28. The safety arrangement of claim 27, wherein the control unit switches to a drive prevention mode if the elevator car reaches one of the person in the shaft sensors when in the service dive mode.

29. The safety arrangement of claim 28, further comprising:

a cancellation appliance located outside the shaft, the cancellation appliance returning the control unit from the drive prevention mode to the normal drive mode.

30. A safety arrangement in an elevator, comprising:

an elevator shaft having a top and a bottom;

a plurality of floors connected to the elevator shaft;

a landing door on each floor;

an elevator car movable within the elevator shaft along a travel path, the elevator car having an elevator door;

a position sensor on the elevator car; and a circuit, the circuit comprising:

a switch at each landing door, the switch being closed when the landing door is closed and the switch being open when the landing door is open;

a resistor in parallel with each switch;

a voltage source;

a current reader; and a control unit to determine if a landing door is opened when the elevator car is not at the landing door;

the resistor at the lowermost floor landing door has a different resistance that other resistors in the circuit.

* * * * *